US011412909B2

(12) United States Patent
Rothenberg

(10) Patent No.: US 11,412,909 B2
(45) Date of Patent: Aug. 16, 2022

(54) DEVICE WITH INDICATOR

(71) Applicant: CareFusion 2200, Inc., San Diego, CA (US)

(72) Inventor: Ashley Rothenberg, Morris Plains, NJ (US)

(73) Assignee: CAREFUSION 2200, INC., San Diego, CA (US)

( * ) Notice: Subject to any disclaimer, the term of this patent is extended or adjusted under 35 U.S.C. 154(b) by 29 days.

(21) Appl. No.: 17/087,409

(22) Filed: Nov. 2, 2020

(65) Prior Publication Data

US 2022/0133120 A1 May 5, 2022

(51) Int. Cl.

| | |
|---|---|
| ***A47L 13/26*** | (2006.01) |
| ***A47L 11/40*** | (2006.01) |
| ***A46B 15/00*** | (2006.01) |

(52) U.S. Cl.

CPC ..... *A47L 13/26* (2013.01); *A47L 11/4011* (2013.01); *A46B 15/0012* (2013.01)

(58) Field of Classification Search

CPC ... A47L 13/26; A47L 11/4011; A47L 15/0012

See application file for complete search history.

(56) References Cited

U.S. PATENT DOCUMENTS

| | | | |
|---|---|---|---|
| 3,703,879 | A | 11/1972 | Huthsing, Jr. |
| 6,389,636 | B1 | 5/2002 | Savill |
| 9,578,957 | B2 | 2/2017 | Patel et al. |
| 2017/0044469 | A1 | 2/2017 | Ready, IV et al. |

OTHER PUBLICATIONS

Coating Changes Color under Pressure : PaintSquare News; https://www.paintsquare.com/news/?fuseaction=view&id=11422.

Molecular scientists develop color-changing stress sensor—ScienceDaily; https://www.sciencedaily.com/releases/2011/08/110818190655.htm.

*Primary Examiner* — Andrew A Horton

(74) *Attorney, Agent, or Firm* — ArentFox Schiff LLP

(57) ABSTRACT

A cleaning device having a handle portion and a surface contacting portion, at least one of the handle portion and the surface contacting portion having a pressure indicator, wherein the pressure indicator provides a reversible signal in response to a certain pressure applied to the cleaning device that is within a certain pressure range.

19 Claims, 2 Drawing Sheets

DEVICE WITH INDICATOR

TECHNICAL FIELD

The present disclosure is directed to cleaning devices comprising pressure indicators.

BACKGROUND

In many contexts, such as in medical settings, scrubbing must be performed in order to properly clean a surface. In these cases, scrubbing generally requires the application of pressure within a certain pressure range, whereas pressure outside of the required pressure range may result in insufficient scrubbing and thus, insufficient cleaning. However, it is often difficult for a user to determine the appropriate pressure to apply to a cleaning device, which increases the risk that proper cleaning has not been achieved. There is thus a need in the art for cleaning devices that allow a user to reliably determine when a certain pressure has been applied and thus, proper cleaning has been achieved.

SUMMARY

The cleaning device as described herein comprises a pressure indicator configured to provide a reversible signal in response to a certain pressure range applied to the cleaning device. The certain pressure range may be a pressure range sufficient for the cleaning device to perform cleaning as described herein.

DETAILED DESCRIPTION

Figure 1:
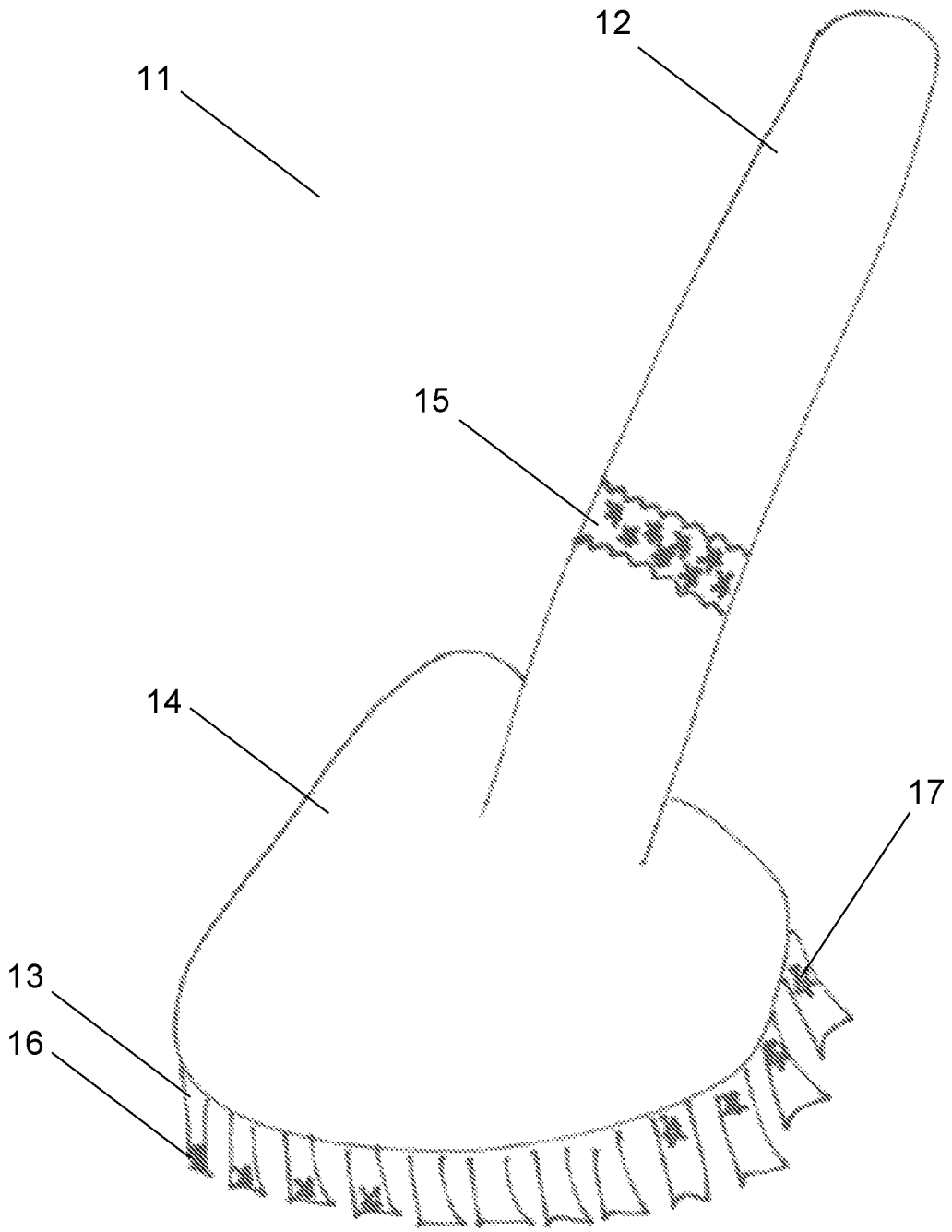
FIG. 1 shows an example cleaning device having a pressure indicator according to aspects of the present disclosure.

The cleaning device as described herein comprises a pressure indicator configured to provide a reversible signal in response to a certain pressure range applied to the cleaning device. The certain pressure range may be a pressure range sufficient for the cleaning device to perform cleaning as described herein.

As used herein, the term "cleaning device" is any device configured to clean a surface as described herein. As used herein, "to clean" means to perform one or more cleaning operations. Example cleaning operations according to the present disclosure include one or more deactivation steps, one or more decontamination steps, one or more washing steps, one or more disinfection steps, or a combination thereof, as will be described herein.

According to some aspects, the cleaning device may be an applicator. As used herein, the term "applicator" refers to a device having at least a body and an application member, wherein the body is configured to house a cleaning fluid (such as a biocide, a biostat, a neutralizing fluid, and/or a rinsing fluid as will be described herein) and is in selective fluid communication with the application member such that fluid may be selectively delivered from the body to the application member. According to some aspects, the application member is a component of the applicator configured to apply the cleaning fluid to a surface, such as a foam sponge material or any suitable material that allows the application of fluid to a surface external to the applicator.

According to some aspects, the body of the applicator may house one or more ampoules and/or similar containers in which the cleaning fluid may be contained prior to application to a surface. According to some aspects, the body may comprise a handle portion, that is, the portion of the cleaning device by which the cleaning device is controlled by a user. It should be understood that in the case wherein the body comprises a handle portion, the body as described herein may alternatively be referred to as a handle portion.

The applicator may further comprise a fluid metering device, such as a pledget, configured to at least partially control and/or direct the flow of the fluid from the body to the application member when the applicator is in use. The applicator may optionally comprise an actuator configured to actuate the applicator, wherein actuation of the applicator corresponds to the body being provided in fluid communication with the application member as described herein.

Non-limiting example applicators that may be used according to the present disclosure may be found, for example, in Applicant's co-pending U.S. application Ser. No. 15/163,500 and in U.S. Pat. Nos. 5,690,958; 6,536,975; 8,708,983; 8,899,859; 9,119,946; 9,572,967; 9,757,551; 9,968,764; 10,076,648; and 10,549,078, the disclosures of which are incorporated herein by reference in their entirety.

In one non-limiting example, the one or more cleaning operations according to the present disclosure may comprise one or more disinfection steps. As used herein, the term "disinfect" means destroying, inactivating, or significantly reducing the concentration of at least a portion of microorganisms present on an inanimate surface and/or reducing or preventing the growth of microorganisms on an inanimate surface. Example inanimate surfaces include, but are not limited, work surfaces in a medical setting, surfaces of medical devices, and combinations thereof. Additionally or alternatively, the one or more cleaning operations according to the present disclosure may comprise one or more antiseptic action steps. As used herein, performing an "antiseptic action" means destroying, inactivating, or significantly reducing the concentration of at least a portion of microorganisms present on a human or animal surface and/or reducing or preventing the growth of microorganisms on a human or animal surface. Example human and animal surfaces include, but are not limited to, skin, wound surfaces, hair follicles, mucous membranes, and combinations thereof. In one example, the one or more disinfection and/or antiseptic action steps may comprise applying a biocide and/or a biostat to a surface sufficient to destroy, inactivate, or significantly reduce the concentration of at least a portion of microorganisms present on the surface and/or to reduce or prevent the growth of microorganisms on the surface.

As used herein, the term "biocide" refers to a chemical agent that inactivates microorganisms as described herein. As used herein, the term "biostat" refers to a chemical agent that reduces and/or prevents the growth of microorganisms as described herein. It should be understood that in some instances, a chemical agent may function as a biocide and a biostat.

Example biocides and/or biostats according to the present disclosure include antibiotics, antiseptics, and disinfectants. As used herein, an "antibiotic" is a naturally occurring or synthetic organic substance which inhibits or destroys selective bacteria or other microorganisms, generally at low concentrations. As used herein, an "antiseptic" is a biocide and/or biostat that destroys or inhibits the growth of microorganisms in or on living tissue. As used herein, a "disinfectant" is a biocide and/or biostat that destroys or inhibits the growth of microorganisms in or on an inanimate surface.

Non-limiting examples of biocides and/or biostats according to the present disclosure include alcohols, aldehydes, anilides, biguanides, diamidines, halogen-releasing agents, silver compounds, peroxygens, phenols, bis-phenols, halophenols, quaternary ammonium compounds, combinations thereof, and solutions thereof.

According to some aspects, the biocide and/or biostat may be an antiseptic solution comprising an antiseptic and a solvent. According to some aspects, the antiseptic solution is an aqueous solution. As used herein, the term "aqueous solution" refers to a solution wherein the solvent comprises at least a majority of water. According to some aspects, the antiseptic solution is an alcoholic solution. As used herein, the term "alcoholic solution" refers to a solution wherein the solvent comprises at least a majority of alcohol.

According to some aspects, the antiseptic may comprise a cationic molecule (i.e., a molecule having a positive charge), such as a cationic surfactant or a cationic biguanide derivative (i.e., a compound derived from biguanide). According to some aspects, the antiseptic may comprise a bis-(dihydropyridinyl)-decane derivative (i.e., a compound derived from bis-(dihydropyridinyl)-decane). According to some aspects, the antiseptic may comprise an octenidine salt and/or a chlorhexadine salt. Non-limiting examples of antiseptics useful according to the present discourse include octenidine dihydrochloride, chlorhexadine gluconate, and a combination thereof.

According to some aspects, the concentration of antiseptic in the antiseptic solution may be from about 0.0001% to about 2.0% w/v, optionally from about 0.01% to about 1% w/v, optionally from about 0.1% to about 0.4% w/v. According to some aspects, the concentration of antiseptic in the antiseptic solution may be from about 0.0001% to about 0.4% w/v, and optionally from about 0.1% to about 0.2% w/v. According to some aspects, the concentration of antiseptic in the antiseptic solution may be from about 0.5% to about 2.0% w/v, and optionally about 2.0% w/v.

According to some aspects, the solvent may comprise an alcohol. Non-limiting examples of alcohols include ethanol, propanol, such as n-propanol and/or isopropanol, and combinations thereof. According to some aspects, the concentration of alcohol in the antiseptic solution may be from about 50% to about 90% v/v, optionally from about 70% to about 80% v/v, and optionally about 70% v/v. According to some aspects, the concentration of alcohol in the antiseptic solution may be from about 10% to about 50% v/v, and optionally from about 20% to about 30% v/v.

According to some aspects, the solvent may comprise water. According to some aspects, the concentration of water in the antiseptic solution may be from about 10% to about 50% v/v, and optionally from about 20% to about 30% v/v. According to some aspects, the concentration of water in the antiseptic solution may be from about 50% to about 90% v/v, and optionally from about 70 to about 80% v/v.

According to some aspects, the antiseptic solution may further comprise a film-forming polymer. Non-limiting examples of film-forming polymers include acrylate polymers, such as acrylamide polymers, octylacrylamide polymers, methacrylate polymers, carboxyacrylate polymers, and polymers having dimethylaminoethyl methacrylate, butyl methacrylate, and methyl methacrylate side groups. The concentration of film-forming polymer may be varied depending on the particular solvent and antiseptic present in the antiseptic solution.

According to some aspects, the concentration of film-forming polymer in the antiseptic solution may be from about 0.1% to about 5% w/v, optionally from about 0.2% to about 3% w/v, optionally from about 0.5% to about 2.0% w/v, and optionally from about 0.75% to about 2.5% w/v.

Example acrylate polymers include, but are not limited to, DERMACRYL® AQF (2-propenoic acid, 2-methyl-, polymer with butyl 2-propenoate and methyl 2-methyl-2-propenoate), DERMACRYL® 79P (2-propenoic acid, 2-methyl-, 2-methylpropyl ester, polymer with 2-propenoic acid and N-(1,1,3,3tetramethylbutyl)-2-propenamide), each manufactured by Akzo Nobel Coatings Inc, and EUDRAGIT® E PO (poly(butyl methacylate-co-(2-dimethylaminoethyl) methacrylate-co-methyl methacrylate) manufactured by Evonik Industries. DERMACRYL® 79P is a hydrophobic, high molecular weight carboxylated acrylic copolymer. EUDRAGIT® E PO is a cationic copolymer based on dimethylaminoethyl methacrylate, butyl methacrylate, and methyl methacrylate According to some aspects, the antiseptic solution may further comprise a tinting agent. In some non-limiting examples, the tinting agent may comprise an anionic tinting agent, such as an anionic dye. The anionic dye may be any dye suitable for medical use, such as dyes approved by the Food and Drug Administration for use in food, drugs, and/or cosmetics (i.e., "D&C" or "FD&C" dyes). Example anionic dyes include, but are not limited to, FD&C Blue No. 1 (Brilliant Blue FCF), FD&C Blue No. 2 (Indigo Carmine), FD&C Green No. 3 (Fast Green FCF), FD&C Red No. 3 (Erythrosine), FD&C Red No. 40 (Allura Red), FD&C Yellow No. 5 (Tartrazine), FD&C Yellow No. 6 (Sunset Yellow FCF), D&C Yellow No. 8 (Fluorescein), D&C Orange No. 4, and combinations thereof. Combinations may be implemented to arrive at a particular color. For example, an orange tint may comprise both FD&C Red No. 40 and D&C Yellow No. 8.

According to some aspects, the concentration of tinting agent in the antiseptic solution may be from about 0.01% to about 0.15% w/v, optionally from about 0.03% to about 0.12% w/v, and optionally from about 0.05% to about 0.09% w/v.

According to some aspects, the antiseptic solution may include one or more plasticizers. The plasticizer may be an ester of an organic acid, for example, triethyl citrate and dibutyl sebacate. The concentration of plasticizer in the antiseptic solution may be from about 0.05% to about 2% w/v, optionally from about 0.75% to about 1.5%, and optionally from about 0.1% to about 1% w/v.

According to some aspects, the antiseptic solution may be the solution used in ChloraPrep™ applicators, which comprises about 2% w/v chlorhexidine gluconate in a solvent comprising about 70% v/v isopropyl alcohol and water.

According to some aspects, the one or more cleaning operations may additionally or alternatively comprise one or more deactivation steps. As used herein, the term "deactivate" means neutralizing a hazardous agent with a neutralizing agent such that the hazardous agent is inhibited from providing an unacceptable effect. It should be understood that deactivation as used herein does not necessarily require removal of the hazardous agent from a surface.

Example hazardous agents according to the present disclosure include any agent that provides an unacceptable effect, such as a physical or a health hazard. Non-limiting examples of hazardous agents according to the present disclosure include bleach and drugs recognized as being hazardous in the art, for example, by the Centers for Disease Control and Prevention (CDC), such as chemotherapeutics, growth hormones, and/or any drug described in the "Hazardous Drugs: Draft NIOSH List of Hazardous Drugs in Healthcare Settings, 2020; Procedures; and Risk Management Information" published on May 1, 2020, the contents of which are expressly incorporated by reference herein in its entirety.

Example neutralizing agents according to the present disclosure include, but are not limited to, Environmental Protection Agency (EPA) registered oxidizers (e.g., peroxide formulations, such as those containing peracetic acid, and sodium hypochlorite), acetic acid and solutions thereof (e.g., white vinegar), thiosulfate and salts thereof (e.g., sodium thiosulfate), bisulfite and salts thereof, metabisulfite and salts thereof, combinations thereof, and/or solutions thereof. Additionally or alternatively, the neutralizing agent may comprise an enzymatic solution and/or a solution comprising a specific deactivating agent tailored to neutralize a specific drug, such as fluorouracil. According to some aspects, the neutralizing agent may be provided as a neutralizing fluid, as described herein.

In one non-limiting example, the neutralizing fluid may be contained in one or more ampoules and/or similar containers as described herein, the one or more ampoules and/or similar containers housed in a body as described herein. In this example, the one or more ampoules and/or similar containers may be in selective fluid communication with a surface contacting portion of the cleaning device, alternatively referred to as an application member as described herein.

It should be understood that according to some aspects, a first neutralizing agent as described herein (e.g., a dilute solution of sodium hypochlorite, or bleach) may itself be a hazardous agent as described herein. As such, a second neutralizing agent may be provided to neutralize the first neutralizing agent. In one non-limiting example, the first neutralizing agent may comprise an aqueous solution of 2% v/v bleach, and the second neutralizing agent may comprise an aqueous solution of 1% w/v sodium thiosulfate. The first neutralizing agent and the second neutralizing agent may independently be provided by the cleaning device as described herein (e.g., contained in one or more separate ampoules and/or similar containers as described herein). In this example, each of the one or more separate ampoules and/or similar containers may be configured to be simultaneously and/or sequentially actuated, for example, by the same or different actuators as described herein. Alternatively, the second neutralizing agent may be applied to the first neutralizing agent via a separate device, or vice versa.

Additionally or alternatively, the one or more cleaning operations may comprise one or more decontamination steps and/or one or more washing steps. As used herein, "decontaminate" means removing a hazardous agent from a surface. It should be understood that the hazardous agent may be any hazardous agent as described herein, including one or more neutralizing agents as described herein and/or one or more neutralized hazardous agents resulting from a deactivation step as described herein. As used herein, "wash" means removing one or more organic and/or inorganic materials (including, but not limited to, one or more microorganisms) from a surface using a detergent, such as a germicidal detergent.

In one non-limiting example, decontamination and/or washing may comprise rinsing a surface with a rinsing fluid, such as water, a peroxide, sodium hypochlorite, and/or an alcohol (to perform decontamination) and/or a germicidal detergent (to perform washing). Each rinsing fluid may be applied to the surface independently, simultaneously, or sequentially. Rinsing may be performed by the cleaning device described herein (for example, via one or more fluid channels provided in communication with a source of rinsing fluid). Additionally or alternatively, one or more rinsing fluids may independently be contained in one or more ampoules and/or similar containers as described herein. Each of the one or more ampoules and/or similar containers may be configured to be simultaneously and/or sequentially actuated, for example, by the same or different actuators as described herein. Additionally or alternatively, rinsing may be performed by a separate device.

FIG. 1 shows an example cleaning device according to the present disclosure. As shown in FIG. 1, cleaning device 11 may comprise a handle portion 12 and a surface contacting portion 13. As described herein, the handle portion 12 is the portion of cleaning device 11 by which cleaning device 11 is controlled by a user.

Figure 2:
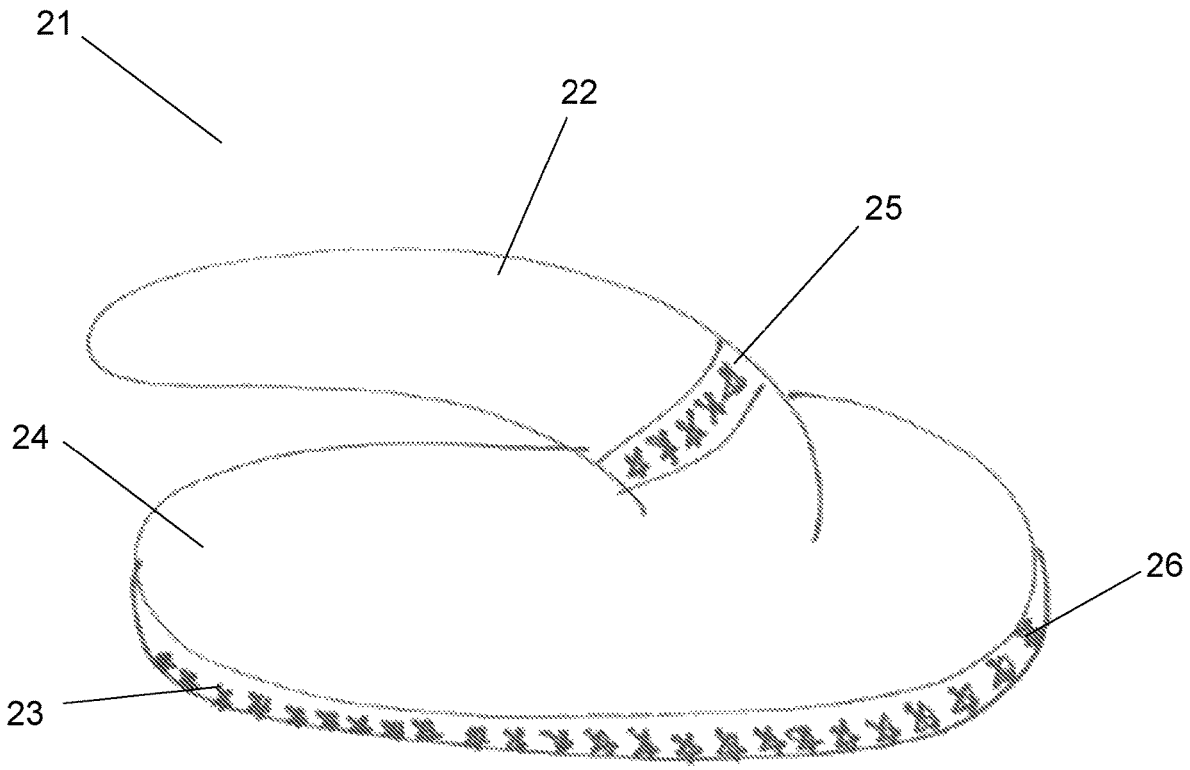
FIG. 2 shows an example cleaning device having a pressure indicator according to aspects of the present disclosure.

In the non-limiting example shown in FIG. 1, surface contacting portion 13 may comprise a plurality of bristles and may be connected to handle portion 12 via bristle plate 14. However, it should be understood that the cleaning device is not particularly limited to the example shown in FIG. 1. For example, surface contacting portion 13 may comprise a plurality of bristles as shown or may additionally or alternatively comprise a pad, a swab, a towelette, a swabstick, a sponge, or a combination thereof. For example, FIG. 2 shows an example of a cleaning device 21 having a handle portion 22 and a surface contacting portion 23, surface contacting portion 23 comprising a pad. In this example, the pad may be connected to handle portion 22 via pad plate 24. In another non-limiting example, the surface contacting portion may function as an application member as described herein such that the surface contacting portion is configured to apply a cleaning fluid to a surface as described herein in addition to simultaneously and/or selectively applying pressure to the surface. It should be understood that in the case wherein the surface contacting portion functions as an application member as described herein, the application member described herein may be alternatively referred to as a surface contacting portion.

It should be understood that surface contacting portion 13, 23 as shown in FIGS. 1 and 2 are configured to perform one or more cleaning operations as described herein. For example, surface contacting portion 13, 23 may have a stiffness and/or topography configured to provide a level of friction against a surface sufficient to at least partially remove a hazardous agent, an organic material, and/or an inorganic material therefrom, as described herein. Additionally or alternatively, surface contacting portion 13, 23 may be configured to function in conjunction with a biocide, a biostat, and/or a neutralizing agent to disinfect a surface and/or deactivate a hazardous agent on a surface, respectively, as described herein. In one non-limiting example, surface contacting portion 13, 23 may comprise a neutralizing agent that, upon contact with a hazardous agent, chemically reacts with the hazardous agent such that the hazardous agent is inhibited from providing an unacceptable effect. The neutralizing agent may be bound to the surface contacting portion and/or may be releasable from the surface contacting portion.

Example materials useful for the surface contacting portion include, but are not limited to, woven materials, nonwoven materials, injection molded materials, porous foams, polyurethane foams, plastic foams, layered materials, single-layer materials, cloth, nylon, polymethyl methacrylate (PMMA), poly(lactic-co-glycolic acid) (PLGA), polyglycolide (PGA), polyolefins, polylactic acid-based materials, polyester, cellulose or blended cellulose materials, polyethylene vinyl acetate (PEVA), and combinations thereof.

It should also be understood that the handle portion of the cleaning device is not particularly limited to the example shown in FIG. 1. For example, handle portion 12 may have a substantially cylindrical shape as shown in FIG. 1 and/or may comprise at least one non-cylindrical portion. In one non-limiting example, handle portion 22 may be curved as shown in FIG. 2. Additionally or alternatively, the handle may be a strap, a ring, and/or another structure attachable to plate 14, 24 or a similar structure such that a user may controllably contact surface contacting portion 13, 23 with a surface. The handle portion may be rigid or flexible. As used herein, the term "rigid" refers to non-deformable when subject to normal operations, such as cleaning operations. As used herein, the term "flexible" refers to mechanically deformable when subject to normal operations, such as cleaning operations.

In one non-limiting example, the cleaning device may be configured as a glove or mitten sufficient for a user to controllably contact the surface contacting portion with a surface to perform one or more cleaning operations as described herein. In this non-limiting example, the handle portion may comprise the inside surface of the glove or mitten (i.e., the surface of the glove or mitten that interfaces a user's hand when worn) and the surface contacting portion may comprise an outside surface of the glove or mitten, such as a palmar surface.

The cleaning device as described herein comprises a pressure indicator configured to provide a reversible signal in response to a certain pressure range applied to the cleaning device. It should be understood that the pressure applied to the cleaning device may be a pressure applied by a user to the handle portion and/or a pressure applied by a surface to the surface contacting portion, as described herein. It should also be understood that the pressure applied by a user to the handle portion of the cleaning device will correspond directly or indirectly with the pressure applied to a surface by the surface contacting portion of the cleaning device and vice versa.

The certain pressure range may be the range of pressure sufficient for the cleaning device to perform one or more cleaning operations as described herein. For example, the certain pressure range may be the range of pressure required for the surface contacting portion to create a level of friction against a surface sufficient to at least partially remove a hazardous agent, an organic material, and/or an inorganic material therefrom. Additionally or alternatively, the certain pressure range may be the range of pressure required for the surface contacting portion to create a level of friction against a surface having a neutralizing agent, rinsing agent, biostat, and/or biocide provided thereon sufficient to provide an acceptable effect as described herein. It should be understood that the certain pressure range may be specific to one or more components of the cleaning device, such as the size, shape, and/or material composition of the surface contacting portion, the properties of the neutralization agent, the properties of the rinsing fluid, and/or the properties of the biocide and/or biostat.

Non-limiting examples of suitable pressure ranges according to the present disclosure include between about 0.1 and 10 psi, optionally between about 0.1 and 5 psi, optionally between about 0.3 and 3.5 psi, optionally between about 0.3 and 3.4 psi, optionally between about 0.3 and 3.3 psi, optionally between about 0.3 and 3.2 psi, optionally between about 0.3 and 3.1 psi, optionally between about 0.3 and 3 psi, optionally between about 0.4 and 3.5 psi, optionally between about 0.4 and 3.4 psi, optionally between about 0.4 and 3.3 psi, optionally between about 0.4 and 3.2 psi, optionally between about 0.4 and 3.1 psi, optionally between about 0.4 and 3 psi, optionally between about 0.5 and 3.5 psi, optionally between about 0.5 and 3.4 psi, optionally between about 0.5 and 3.3 psi, optionally between about 0.5 and 3.2 psi, optionally between about 0.5 and 3.1 psi, and optionally between about 0.3 and 5 psi.

According to some aspects, the signal provided by the pressure indicator is reversible such that the signal is observable to a user while a level of pressure is being applied to the cleaning device that is within the certain pressure range, and the signal is not observable to the user while a level of pressure is being applied to the cleaning device that is outside of the certain pressure range.

According to some aspects the reversible signal may be optical, audible, or a combination thereof. For example, the reversible signal may be an optical signal comprising a change in color, the presence of a light, a change in intensity of a light, or a combination thereof. It should be understood that the pressure indicator is provided relative to the cleaning device such that the reversible signal is observable to a user when the user is using the cleaning device to clean a surface as described herein.

For example, FIG. 1 shows an example wherein pressure indicator 15 is provided as a component of handle portion 12. In this example, pressure indicator 15 is in the line of vision of a user when the user is using the cleaning device to clean a surface (that is, when the user is controlling cleaning device 11 via handle portion 12). In this example, pressure indicator 15 may have a first state when the user is providing a level of pressure to the cleaning device that is outside of a certain pressure range. The first state may be a first optical state, such as a first color, a first light intensity, or a combination thereof. When using cleaning device 11, a user may provide pressure to handle portion 12, this pressure corresponding to the pressure provided by surface contacting portion 13 to a surface. In this non-limiting example, pressure indicator 15 may have a second state when a user is applying a level of pressure to the cleaning device that is within the certain pressure range, the second state being different from the first state. For example, the second state may be a second color, a second light intensity, or a combination thereof. It should be understood that in this example, the reversible signal is the change from the first state to the second state. In this way, pressure indicator 15 may reversibly signal to a user when a certain pressure is being applied to handle portion 12 and thus, when an acceptable pressure against a surface is achieved.

It should be understood that the example shown in FIG. 1 is not particularly limiting. For example, in addition to or alternatively to pressure indicator 15, pressure indicator 16 may be provided as a component of surface contacting portion 13, for example, in a position proximal a surface contacting end thereof, as shown. Additionally or alternatively, pressure indicator 17 may be provided as a component of surface contacting portion 13, for example, in a position proximal a plate contacting end thereof, as shown. In these examples, pressure indicators 16, 17 may be provided in the line of vision of a user when the user is using the cleaning device. Additionally or alternatively, the first and/or second state of pressure indicators 16, 17 may be such that the reversible signal is observable to a user without requiring pressure indicators 16, 17 to be in the line of vision of a user when the user is using the cleaning device. For example, the reversible signal may be a change in light emitted from pressure indicators 16, 17, the light being visible on a surface. It should be understood that, while not shown, one or more additional or alternative pressure indicators may be provided as a component of any portion of the cleaning device, such as a component of bristle plate 14 or a component of an applicator body, in the case wherein the cleaning device comprises an applicator body that is separate from the handle portion.

FIG. 2 shows another non-limiting example of a cleaning device 21 having a handle portion 22 with a pressure indicator 25. FIG. 2 also shows a second pressure indicator 26 provided as a component of surface contacting portion 23, as described herein.

According to some aspects, the pressure indicator may comprise a cavity having at least one transparent or translucent outer surface, wherein the cavity contains a signaling material configured to provide the reversible signal as described herein. It should be understood that the at least one transparent and/or translucent outer surface is provided such that a user may observe the signal provided by the signaling material contained in the cavity.

For example, in the non-limiting example wherein the pressure indicator 15 is provided as a component of the handle portion 12 as shown in FIG. 1, the at least one transparent and/or translucent outer surface may be an outer surface of the handle portion. In another non-limiting example wherein the pressure indicator 16 and/or 17 is provided as a component of surface contacting portion 13, surface contacting portion 13 having a plurality of bristles as shown in FIG. 1, at least a portion of the bristles may each function as a cavity as described herein, wherein each of the bristles has at least one transparent and/or translucent outer surface. In yet another non-limiting example wherein the pressure indicator 26 is provided as a component of surface contacting portion 23, surface contacting portion 23 comprising a pad as shown in FIG. 2, at least a portion of the pad may function as a cavity as described herein, wherein at least one surface of the pad is transparent and/or translucent.

Example transparent and/or translucent materials include, but are not limited to, elastic materials, plastic materials, polypropylene, polyethylene, polyethylene vinyl acetate, thermoplastic elastomers, and combinations thereof.

According to some aspects, in addition to or instead of a cavity, the pressure indicator may comprise at least one surface of the cleaning device, the at least one surface containing a signaling material. For example, in the non-limiting example wherein the pressure indicator 15 is provided as a component of the handle portion 12 as shown in FIG. 1, the pressure indicator 15 may comprise a surface of the handle portion. In another non-limiting example wherein the pressure indicator 16 and/or 17 is provided as a component of the surface contacting portion 13, the surface contacting portion 13 having a plurality of bristles as shown in FIG. 1, the pressure indicator 16 and/or 17 may comprise a surface of at least one bristle. In yet another non-limiting example wherein the pressure indicator 26 is provided as a component of the surface contacting portion 23, surface contacting portion 23 comprising a pad as shown in FIG. 2, the pressure indicator 26 may comprise a surface of the pad. According to some aspects, the at least one surface may comprise a coating comprising the at least one signaling material. Additionally or alternatively, the at least one surface may have the at least one signaling material embedded therein.

The signaling material according to the present disclosure may be any material configured to provide a reversible signal as described herein. In one non-liming example, the signaling material may comprise a material having a first state and a second state in response to a certain stimulus, where the first state is different from the second state as described herein. It should be understood that the certain stimulus may be pressure applied by a user and/or by a surface directly to the signaling material as described herein. Additionally or alternatively, the certain stimulus may be a stimulus that results from a user and/or a surface applying pressure to a component of the cleaning device, examples of such stimuli including, but not limited to, exposure to light, mechanical deformation, a change in viscosity, pressure applied by another component of the cleaning device, or a combination thereof.

In one non-limiting example, the cleaning device may be configured such that in use, a user applies pressure to the handle portion as described herein. The handle portion may be configured to mechanically deform in response to a certain level of pressure being applied thereto. In this example, the pressure indicator may be provided as a component of the handle portion such that a certain degree of mechanical deformation of the handle portion prompts the signaling material to change from a first state (such as a first color) to a second state (such as a second color) as described herein, thereby providing a reversible signal in response to the certain pressure.

In another non-limiting example, the cleaning device may be configured such that in use, a user applies pressure to the handle portion, which corresponds to pressure applied to a surface by the surface contacting portion. The surface contacting portion may be configured to mechanically deform when it is applying a certain level of pressure to the surface. In this example, the pressure indicator may be provided as a component of the surface contacting portion such that a certain degree of mechanical deformation of the surface contacting portion prompts the signaling material to change from a first state (such as a first color) to a second state (such as a second color) as described herein, thereby providing a reversible signal in response to the certain pressure.

Non-limiting examples of signaling materials as described herein are materials having mechanochromic, photoelastic, thermochromic, photoluminescent, light-emitting, photochromic, and/or piezochromic properties.

In one non-limiting example, the signaling material may comprise a piezochromic material. As used herein, the term "piezochromic" refers to the tendency to change color in response to a certain pressure or pressure range being applied thereto. Non-limiting examples of piezochromic materials include, but are not limited to, electrocylic ring-opening mechanophores, liquid crystal cholesterol esters, gold nanoparticles, and combinations thereof. According to some aspects, the electrocylic ring-opening mechanophore may comprise spiropyran, the spiropyran molecule optionally incorporated in a poly(methyl acrylate) polymer or a poly(methyl methacrylate) polymer. Example piezochromic materials useful according to the present disclosure include those described in U.S. Pat. Nos. 9,578,957 and 6,389,636, the contents of which are incorporated herein by reference in their entirety.

Example mechanochromic, photoelastic, thermochromic, and/or photochromic materials include, but are not limited to, difluorenylsuccinonitrile polymers, poly(acetylene)s, poly(phenylene)s, poly(p-phenylene vinylene)s, poly(pyrrole)s, poly(anthraquinone)s, poly(diacetylene)s, poly(thiophene)s, poly(tetraphenylethylene)s, aggregachromic dye containing polymers, cis-polyisoprene, polybutadiene, ethylene-propylene, styrene-butadiene copolymers, poly(diarylethene)s, polystyrene with pendant chromophores, naphthopyran conjugates including poly(n-butyl acrylate), poly (dimethylsiloxane) and polyethylene glycol, matrix polymers such as polycaprolactone (PCL), polylactic acid, poly(lactic-co-glycolic)acid with embedded mechanochromic, photochromic, or thermochromic dyes.

Examples photoluminescent materials include, but are not limited to, photoluminescent dyes including planar aromatic compounds such as naphthalene, pyrene, anthracene, phenanthrene and their derivatives such as 2,6-naphthalenedicarboxylate, and 1,3-dipyrenylpropane; conjugated polymers such as poly(9,9-dioctylfluorene) and poly(3-methyl-4-octyl-thiophene) and their constituent moieties such as 9-phenylfluorene, as well as oligomers thereof; planar conjugated molecules with electron withdrawing groups such as p,p'-diformyl-trans,trans,trans-1,6-diphenyl-1,3,5-hexatriene, substituted perylenes such as bis(neopentylimido) perylene, and oligo(phenylene vinylene)s (OPVs). According to some aspects, the photoluminescent dye may be provided with one or more carrier materials, such as a low density polyethylene. Example photoluminescent dyes and carrier materials useful according to the present disclosure include, but are not limited to, those described in U.S. Pat. No. 7,223,988, the contents of which is incorporated herein by reference it its entirety.

Example light-emitting molecules according to the present disclosure include, but are not limited to, porphyrins. According to some aspects, the light-emitting molecule may be provided with one or more polymersomes. For example, the signaling material may comprise one or more polymersomes studded with light-emitting molecules such as porphyrins. As used herein, the term "polymersome" refers to an artificial vesicle comprising one or more amphiphilic synthetic block copolymers. Example amphiphilic synthetic block copolymers useful according to the present disclosure include, but are not limited to, poly(ethylene oxide)-block-poly(propylene oxide)-block-poly(ethylene oxide), copolymers containing poly(L-amino acid) and poly(ester) hydrophobic blocks, poly(2-hydroxyethylmethacrylate)-b-poly (dimethylsiloxane), poly(styrene)-b-poly(4-vinylpyridine), poly(ethylene oxide)-b-polycaprolactone, poly(styrene)-b-poly(acrylic acid), polyurethanes with a poly(phenylene ether) hydrophobic segment.

According to some aspects, the pressure indicator may require no external power sources to provide the reversible signal.

According to some aspects, the cleaning device having the pressure indicator may be multi-use such that the same device may be used to perform more than one cleaning actions, wherein each cleaning action provides an acceptably clean surface. As used herein, the term "acceptably clean" may refer to a certain microbial load, complete or partial neutralization of a hazardous agent, complete or partial removal of a hazardous agent, organic material, and/or inorganic material, or a combination thereof. According to some aspects, a surface may be deemed acceptably clean after a certain period of cleaning by the cleaning device, wherein cleaning requires the application of pressure to the cleaning device that is within a certain pressure range as described herein.

The present disclosure is also directed to methods of using the cleaning device as described herein. According to some aspects, the method comprises providing a cleaning device having a pressure indicator as described herein, applying pressure to the cleaning device, and observing the pressure indicator for a reversible signal. The method may further comprise performing one or more cleaning operations on a surface by contacting the surface contacting portion of the cleaning device with the surface, wherein the one or more operations comprises applying a level of pressure to the handle portion sufficient to provide the reversible signal.

While the aspects described herein have been described in conjunction with the example aspects outlined above, various alternatives, modifications, variations, improvements, and/or substantial equivalents, whether known or that are or may be presently unforeseen, may become apparent to those having at least ordinary skill in the art. Accordingly, the example aspects, as set forth above, are intended to be illustrative, not limiting. Various changes may be made without departing from the spirit and scope of the disclosure. Therefore, the disclosure is intended to embrace all known or later-developed alternatives, modifications, variations, improvements, and/or substantial equivalents.

Thus, the claims are not intended to be limited to the aspects shown herein, but are to be accorded the full scope consistent with the language of the claims, wherein reference to an element in the singular is not intended to mean "one and only one" unless specifically so stated, but rather "one or more." All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed as a means plus function unless the element is expressly recited using the phrase "means for."

Further, the word "example" is used herein to mean "serving as an example, instance, or illustration." Any aspect described herein as "example" is not necessarily to be construed as preferred or advantageous over other aspects. Unless specifically stated otherwise, the term "some" refers to one or more. Combinations such as "at least one of A, B, or C," "at least one of A, B, and C," and "A, B, C, or any combination thereof" include any combination of A, B, and/or C, and may include multiples of A, multiples of B, or multiples of C. Specifically, combinations such as "at least one of A, B, or C," "at least one of A, B, and C," and "A, B, C, or any combination thereof" may be A only, B only, C only, A and B, A and C, B and C, or A and B and C, where any such combinations may contain one or more member or members of A, B, or C. Nothing disclosed herein is intended to be dedicated to the public regardless of whether such disclosure is explicitly recited in the claims.

The word "about" is used herein to mean within ±5% of the stated value, optionally within ±4%, optionally within ±3%, optionally within ±2%, optionally within ±1%, optionally within ±0.5%, optionally within ±0.1%, and optionally within ±0.01%.

What is claimed is:

1. A cleaning device comprising:

a handle portion, and a surface contacting portion, wherein at least one of the handle portion and the surface contacting portion comprises a pressure indicator, and wherein the pressure indicator is configured to provide a reversible signal in response to a certain pressure range applied to the cleaning device.

2. The cleaning device according to claim 1, wherein the handle portion houses one or more ampoules containing a fluid.

3. The cleaning device according to claim 2, wherein the handle portion is in selective fluid communication with the surface contacting portion.

4. The cleaning device according to claim 3, wherein the cleaning device further comprises an actuator configured to actuate the cleaning device, wherein actuation comprises providing the handle portion in fluid communication with the surface contacting portion.

5. The cleaning device according to claim 2, wherein the fluid is an antiseptic solution.

6. The cleaning device according to claim 5, wherein the antiseptic solution comprises an antiseptic and a solvent.

7. The cleaning device according to claim 2, wherein the fluid comprises a neutralizing agent.

8. The cleaning device according to claim 1, wherein the surface contacting portion comprises a neutralizing agent.

9. The cleaning device according to claim 1, wherein the pressure indicator comprises a signaling material configured to provide the reversible signal, the signaling material comprising at least one material having mechanochromic, photoelastic, photoluminescent, light-emitting, photochromic, and/or piezochromic properties.

10. The cleaning device according to claim 9, wherein the pressure indicator comprises a cavity having at least one transparent or translucent outer surface, wherein the cavity contains the signaling material.

11. The cleaning device according to claim 9, wherein the pressure indicator comprises at least one surface of the handle portion and/or the surface contacting portion, wherein the at least one surface comprises a coating containing the signaling material.

12. The cleaning device according to claim 9, wherein the pressure indicator comprises at least one surface of the handle portion and/or the surface contacting portion, wherein the at least one surface comprises the signaling material embedded therein.

13. The cleaning device according to claim 9, wherein the signaling material is a piezochromic material.

14. The cleaning device according to claim 9, wherein the signaling material comprises a photoluminescent dye.

15. The cleaning device according to 1, wherein the signaling material is configured to provide the reversible signal in response to the certain pressure range being applied to the signaling material.

16. The cleaning device according to claim 1, wherein the signaling material is configured to provide the reversible signal in response to a certain stimulus provided by the handle portion, and wherein the handle portion is configured to provide the certain stimulus to the signaling material in response to the certain pressure range applied to the cleaning device.

17. The cleaning device according to claim 16, wherein the certain stimulus is mechanical deformation.

18. The cleaning device according to claim 1, wherein the surface contacting portion comprises bristles and/or a pad.

19. The cleaning device according to claim 1, wherein the surface contacting portion is configured to clean human skin.

* * * * *